US005097667A

United States Patent [19]

Gramkow

[11] Patent Number: 5,097,667

[45] Date of Patent: Mar. 24, 1992

[54] APPARATUS AND A METHOD FOR EMPTYING AND RECHARGING A REFRIGERATION SYSTEM

[76] Inventor: Asger Gramkow, Gammelgaard 27, DK-6440 Augustenborg, Denmark

[21] Appl. No.: 579,367

[22] Filed: Sep. 7, 1990

[51] Int. Cl.[5] ..... F25B 45/00

[52] U.S. Cl. ..... 62/77; 62/149; 62/292

[58] Field of Search ..... 62/77, 85, 149, 292, 62/474, 475, 174

[56] References Cited

U.S. PATENT DOCUMENTS

| | | | |
|---|---|---|---|
| 4,363,222 | 12/1982 | Cain | 62/292 |
| 4,441,330 | 4/1984 | Lower et al. | 62/149 |
| 4,903,499 | 2/1990 | Merritt | 62/149 |

*Primary Examiner*—Henry A. Bennett
*Assistant Examiner*—John Sollecito
*Attorney, Agent, or Firm*—Watson, Cole, Grindle & Watson

[57] ABSTRACT

An apparatus for emptying and recharging a refrigeration system (42) by on-site servicing comprising a discharge container (1) and a charging container (2). Each of said containers (1,2) comprises two chambers (20,21);(30,31) for mutual heat exchange. Said discharge container (1) comprises a storage chamber (20) for liquid refrigerant and a suction chamber (21) positioned inside or outside the storage chamber. Said charging container (2) comprises a storage chamber (30) for clean liquid refrigerant and a metering chamber (31) for gaseous refrigerant to be charged to the refrigeration system (42). Said refrigeration system (42) is emptied by means of a compressor (3). Said recharging is effected by heating element (32) which evaporates the refrigerant introduced into the metering chamber (31) as a gaseous refrigerant until a predetermined pressure is established. The metering chamber (31) is recharged a predetermined number of times depending on the capacity of the refrigeration system (42) to be serviced.

6 Claims, 2 Drawing Sheets

APPARATUS AND A METHOD FOR EMPTYING AND RECHARGING A REFRIGERATION SYSTEM

BACKGROUND OF THE INVENTION

The present invention relates to an apparatus for emptying and recharging a refrigeration system and of the type which comprises a discharge container for drawn-off polluted refrigerant, a charging container for clean refrigerant to be charged, pump means, means for metering the refrigerant to be charged and conduit means comprising closing valves and arranged for connecting the refrigeration system and the elements forming part of the apparatus.

Such apparatus is used for servicing refrigeration systems which are for example used for the refrigeration or cooling of foods, air conditioning and other systems wherein a refrigerant is compressed, expanded and condensed.

When servicing a refrigeration circuit, it has been customary to ventilate the circuit thus discharging the polluted refrigerant into the atmosphere. However, this has become unacceptable, and apparatus of the above-mentioned type for servicing refrigeration systems have been manufactured. Examples of such apparatus are known, e.g. from U.S. Pat. Nos. 4,363,222 and 4,364,236. The apparatus disclosed in these patents are associated with problems relating to the risk of contaminating the refrigerant charged. Moreover, the amount of refrigerant used in said apparatus will be inaccurate and thus said apparatus will not permit minimization of refrigerant consumption and simultaneous charging of such an accurate amount which is necessary in order not to damage the compressor and in order to obtain good operation efficiency.

The requirements for accurate recharging are becoming increasingly important as environmental considerations force the producers to reduce the consumption of refrigerant, especially the consumption of freon. When new types of freon, e.g. R134A, is marketed, the price level is expected to increase by approximately 10-15 times the present level for refrigerants. Thus the price will induce a requirement for minimizing refrigerant consumption.

It is an object of the invention to provide an apparatus and a method for easy and safe emptying and recharging a refrigeration system, which makes it possible to minimize refrigerant consumption.

A further object of the invention is to provide a portable apparatus for emptying and recharging a refrigeration system, which apparatus is useful for on-site servicing and for an automatic sequence of operations for emptying and subsequently recharging an accurate amount of refrigerant.

It is another object of the invention to provide an apparatus for emptying and recharging a refrigeration system wherein the refrigerant condensation and the evaporation processes support each other when emptying the refrigeration system.

It is a further object of the invention to provide an apparatus for emptying and recharging a refrigeration system wherein only one compressor is required for the removal of polluted refrigerant and evacuation of the refrigeration system.

It is yet another object of the invention to provide an apparatus and a method for emptying and recharging a refrigeration system wherein a gaseous pressurized refrigerant is charged to said system, which gaseous refrigerant is produced by heating clean liquid refrigerant.

According to the present invention the above-mentioned apparatus is provided wherein the discharge container comprises a storage chamber for liquid refrigerant and a suction chamber, which are established in a mutual heat exchanging relationship, wherein the charging container comprises a storage chamber for liquid refrigerant and a metering chamber, which are established in a mutual heat exchanging relationship, wherein the pump means consist of a compressor, which, through the conduit means, is arranged between the chambers of the discharge container by an appropriate setting of the closing valves and which, through another setting of the closing valves, is arranged between the refrigeration system and the atmosphere in order to evacuate the refrigeration system, wherein the storage chamber of the charging container comprises a heating element for heating the liquid refrigerant, wherein a connection is provided between the storage chamber and the metering chamber for introducing a gaseous refrigerant into the metering chamber, wherein said connection is provided with means for metering the pressure and for cutting off the connection when a predetermined pressure is obtained and wherein the conduit means establish a connection between the metering chamber and the refrigeration system for charging clean pressurized refrigerant.

The method according to the invention wherein an apparatus of the above-mentioned type is used comprises the steps of

- emptying refrigerant from the refrigeration system as pump means in the form of a compressor draw refrigerant into a suction chamber in the discharge container,
- transmitting the gaseous refrigerant through the compressor to a storage chamber arranged in the discharge container in which storage chamber the refrigerant is condensed,
- automatically disconnecting the compressor when the refrigerant has been discharged,
- changing the position of the closing valves in order to evacuate refrigerant from the refrigeration system as the compressor, when blowing off into the atmosphere, creates a vacuum in the refrigeration system,
- evaporating clean refrigerant contained in the storage chamber of the charging container,
- conducting the gaseous refrigerant into the metering chamber of the charging container,
- using the evaporated and pressurized refrigerant for flushing the refrigeration system and transmitting said refrigerant through the compressor to the discharge container,
- evacuating again refrigerant from the refrigeration system,
- charging clean refrigerant into the refrigeration system as gaseous refrigerant is introduced into the metering chamber until a predetermined pressure is reached and the pressurized refrigerant has flowed into the refrigeration system after the position of the closing valves has been changed, and
- charging and emptying the metering chamber in a corresponding way until a predetermined number of cycles have been effected whereby a well-defined amount of refrigerant has been charged to the system.

In the practice of the invention, the apparatus is coupled to an emptying stub of the refrigeration system according to any method well-known to a person skilled in the art.

The apparatus comprises several elements which are mutually connected by means of conduits comprising electrically and/or manually operated valves. Moreover, the apparatus comprises known monitoring and control equipment providing information to a pre-programmed microprocessor. The microprocessor is built into a control box effecting automatic control of different operation sequences which are chosen by the operator. However, such further equipment is well-known to the person skilled in the art and is not illustrated herein.

When a connection has been established between the apparatus and the refrigeration system, the following sequences for emptying and recharging are conducted in a closed circuit. This provides good security against undesired spill of refrigerant. During the discharging and evacuation, only a compressor is used. This simplifies the apparatus as compared to the prior art, apparatus which uses both a compressor and a vacuum pump. The compressor is arranged between the two chambers of the discharge container which is situated in an insulated unit. Hereby the evaporation process, which takes place in the suction chamber, is supported by the condensation process which takes place in the storage chamber. In this way it is possible to reduce the energy consumption and to accelerate the discharging. By activating the control box, it is possible to switch the closing valves and during the following charging, the heating element is used to produce gaseous refrigerant. As the metering chamber and the storage chamber of the charging container are in a heat exchanging relationship inside an insulated unit, it is possible to maintain the temperature of the gaseous refrigerant constant. Together with a specific differential pressure existing for the metering chamber, the constant temperature makes it possible to establish a high degree of accuracy even when charging small amounts.

BRIEF DESCRIPTION OF THE DRAWING

The above-mentioned objects and advantages of the invention will be explained in the following description and accompanying drawing wherein.

DESCRIPTION OF THE PREFERRED EMBODIMENT

The apparatus of the invention is intended to be of such a design and size as to be portable and utilised by operators on site. Accordingly, the illustrated apparatus may be mounted in a permanent manner upon a handcart (not shown) which is known per se whereby the apparatus may be readily transported to the site where a refrigeration system is to be serviced.

Figure 1:
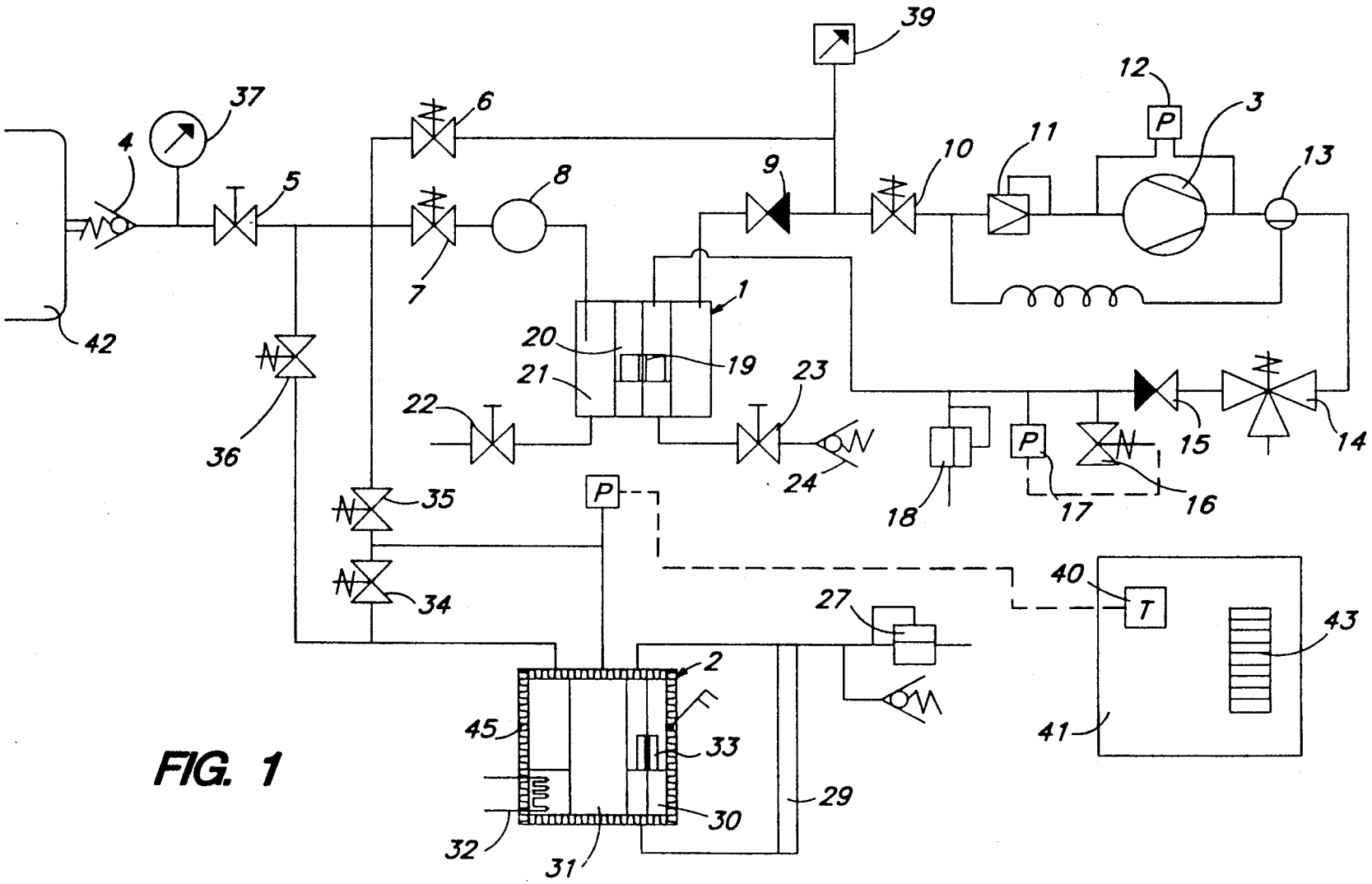
FIG. 1 is a schematic view of a preferred embodiment of a circuit in an apparatus according to the invention.
Figure 2:
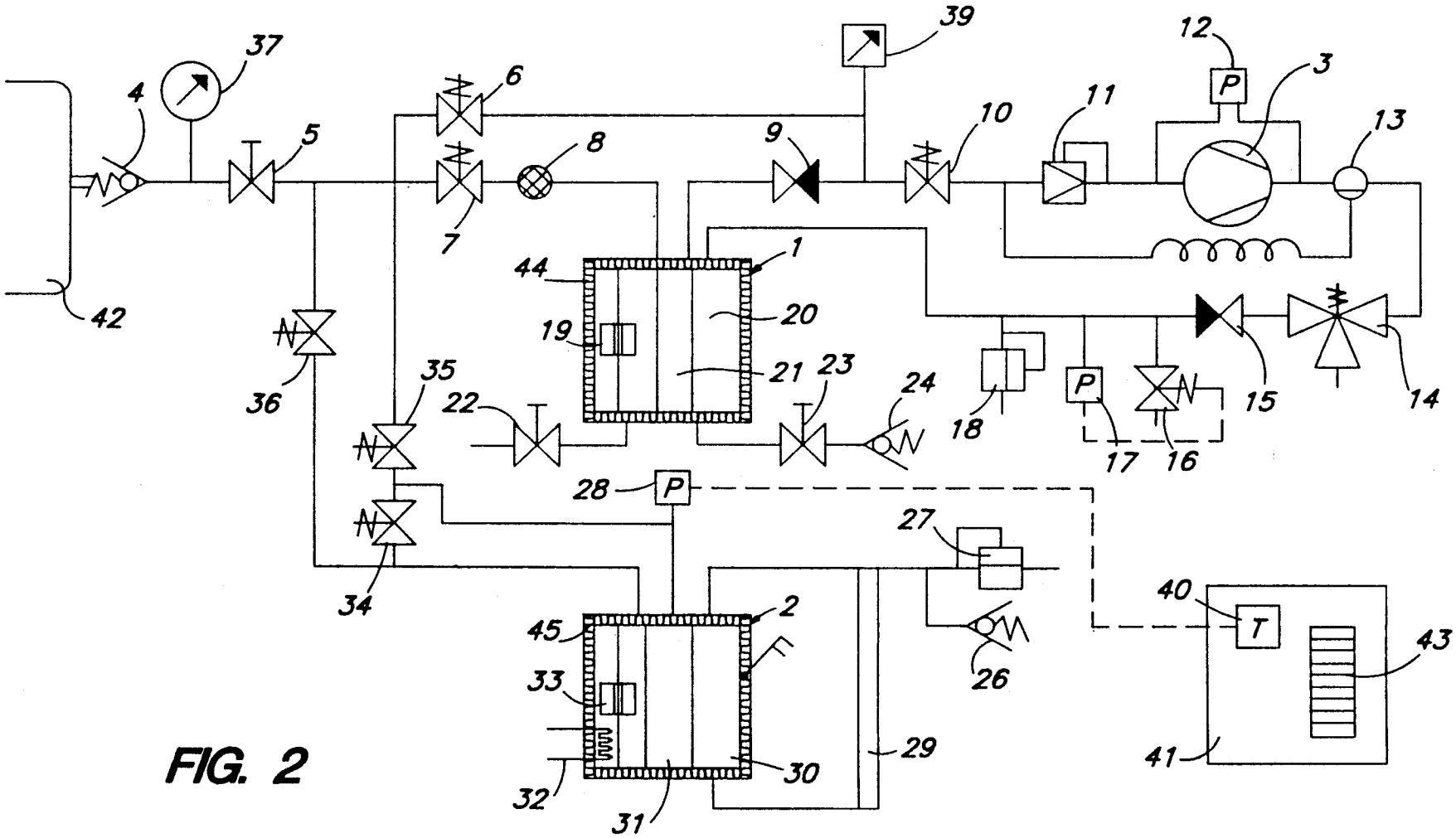
FIG. 2 is a schematic view of another embodiment of the circuit in an apparatus according to the invention.

As illustrated schematically in both FIG. 1 and FIG. 2, the apparatus according to the invention comprises a discharge container 1 for drawn-off polluted refrigerant and a charging container 2 for clean refrigerant to be charged. Moreover, the apparatus comprises a compressor 3 and conduit means comprising closing valves and other elements which are to be explained more in detail in connection with the description of the operation mode for the apparatus. The conduit means are arranged so as to be connected to the refrigeration system via a stub 4, preferably of a self-closing type. A valve 5 is mounted in the conduit means in close vicinity of the stub 4.

The above-described apparatus is operated in the following manner:

By means of a tube, a refrigeration system 42 to be serviced is connected to the stub 4. At this time the valve 5 is closed and a pressure gauge 37 makes it possible to decide whether the system is pressurized. Hereby it is possible to determine whether the system contains refrigerant. If it does, the valve 5 is opened whereby a connection is established between the refrigeration system and the apparatus according to the invention. The apparatus is supplied with electrical effect, e.g. 220 V or 115 V, and may now be started by activating a pressure button 43 in the control box 41 in order to establish the different operation modes, each establishing a sequence of operations:

A) start,
B) emptying,
C) first evacuation,
D) flushing,
E) discharge,
F) second evacuation,
G) recharging,
H) stop,
I) change between automatically or semi-automatically operation, and
J) replenishing of the storage chamber with new supplies of freon.

By activating the start button A, the compressor 3 is started and magnetic valves 7,10 and 14 are opened. Hereby a connection is established to the discharge container 1 which comprises a storage chamber 20 for polluted refrigerant and a suction chamber 21.

As illustrated both in FIG. 1 and FIG. 2 the suction chamber 21 and the storage chamber 20 are established in a mutual heat exhanging relationship. When opening the valves 7,10 and 14, the refrigeration system 42 is connected to the storage chamber 20 of the discharge container through an acid filter 8, the suction chamber 21, a check valve 9, a capacity regulator 11, a compressor 3, an oil separator 13 and a check valve 15. When the compressor is working, the refrigerant is drawn from the refrigeration system to the suction chamber 21 and the temperature inside the discharge container 1 causes the refrigerant to evaporate whereas oil and other impurities, if any, drawn off from the refrigeration system are separated in the suction chamber 21. During standstills, these materials may be discharged by opening a valve 22.

In the preferred embodiment of the circuit illustrated in FIG. 1 the suction chamber 21 is positioned outside the storage chamber 20. As no insulated mantle is provided, said suction chamber 21 is established in heat exchanging relationship with the surroundings. Hereby, the ambient temperature enhances the evaporation process taking place in the suction chamber 21.

In the embodiment illustrated in FIG. 2 the suction chamber 21 and the storage chamber 20 are arranged inside an insulated mantle 44. This might be convenient under certain circumstances and a heat exchange will be provided only between the two chambers whereby the evaporation process in the suction chamber 21 is supported by the condensation process in the storage chamber 20.

A level indicator 19 is used for monitoring the liquid level in the storage chamber 20 which indicator emits a signal to the control box 41 whereby the compressor 3 is stopped when the maximum allowable liquid level has been reached. When the storage chamber is to be emptied, it is done by opening a valve 23 arranged in a conduit which is connected to a stub 24. The stub 24 is connected to a transport container or the like for polluted refrigerant.

A pressure switch 12 monitors the pressure prevailing above the compressor 3 and causes a disconnection of the compressor in case a predetermined pressure level is reached at the high pressure side and the low pressure side of the compressor. Moreover, the compressor switch 12 emits a signal and causes the compressor 3 to be disconnected when the pressure, existing in the suction chamber 21, has such a low value that it indicates that the refrigerant is discharged.

After terminating this sequence, a first evacuation may start and the operator depresses the button C on the control box 41. By depressing the button C, magnet valves 6 and 10 are opened and the position of the magnet valve 14 is changed thus establishing a blow-off to the atmosphere. All other illustrated magnet valves are closed. The blow-off might be effected through a filter (not shown) which filters off any remaining refrigerant.

The compressor 3 evacuates the refrigeration system 42 via a magnet valve 6. The vacuum established is monitored by a vacuum sensor 39 which disconnects the compressor 3 via the control box 41 when a sufficiently high vacuum level has been reached. Hereafter it is possible to effect a flushing and the operator depresses the button D on the control box 41. In this position the discharge container 1 and the compressor 3 are disconnected, i.e. the magnet valves 6,7,10 and 14 are closed.

Flushing of the refrigeration system is necessary in order to remove any moisture which might otherwise deteriorate the operation efficiency of the refrigeration system. The risk of any moisture remaining in the system occurs because the apparatus uses only a compressor which is unable to establish the same vacuum level which might be established by a vacuum pump. However, the use of a compressor is far more economical than a vacuum pump.

During the emptying process, non-condensable gases (air) might be drawn off in the storage chamber 20. These gases are automatically blown off by means of a pressure switch 17 which opens a magnet valve 16 when a predetermined pressure has been reached. A safety valve 18 is preset in order to open at a pressure which is higher than the predetermined pressure. Moreover, the apparatus comprises a capillary tube 38 which damps the return of oil which is separated by the oil separator 13 and which might be thrown out from the compressor 3. The flushing is effected by means of the charging container 2 which is provided as a unit having an insulation 45. The charging container 2 comprises a storage chamber 30 for clean liquid refrigerant and a metering chamber 31. The storage chamber 30 comprises a heating element 32 for heating the clean liquid refrigerant, said heating is thermostatic controlled. Furthermore, the storage chamber 30 comprises an electronic level sensor 33 and a sight glass 29 for visual monitoring of the liquid level.

When flushing, the magnet valve 34 is opened whereby gaseous refrigerant is let into the metering chamber 31 as the heating element 32 has established a temperature and accordingly a pressure which effects evaporation of the refrigerant in the storage chamber 30. A pressure switch 28 monitors said pressure and disconnects when a predetermined pressure is reached. When this happens and the switches of the pressure switch 28 change from one position to the opposite position, the magnet valve 34 is closed and a magnet valve 35 is opened whereby an open connection is established to the refrigeration system through the valve 5. The gaseous refrigerant, which has been compressed in the metering chamber 31, will flow into the refrigeration system 42. When the pressure in the metering chamber 31 drops to a predetermined level, the connection between the charging container 2 and the refrigeration system 42 is interrupted. The flushing might be effected by filling the metering chamber 31 two or three times in accordance with the above-described process.

Then the refrigerant used for flushing is discharged from the system. Said discharge is effected as described above and starts when the operator depresses the button E. Thereafter, the operator depresses the button F and a second evacuation is effected in a way corresponding to the first evacuation.

Hereafter, the recharging is started by depressing the button G. The recharging is started in the same way as the initial steps of the flushing as the heating element 32 evaporates refrigerant which flows into the metering chamber 31 via the open magnet valve 34 until a predetermined pressure is reached. When the predetermined pressure is reached, the pressure switch 28 switches from a first position to another position which causes a signal to close the magnet valve 34 and to open the magnet valve 35. Hereby the pressure in the metering chamber 31 drops and at a predetermined pressure level the pressure switch 28 switches to its initial position whereby the magnet valve 35 is closed and the magnet valve 34 is opened. Thus, the metering chamber 31 is refilled again until the predetermined pressure has been reached.

This switching continues until a counter 40 stops the process when it has run through a predetermined number of cycles.

As the metering chamber 31 and the storage chamber 30 are in a mutual heat exchanging relationship and are arranged inside the insulation 44, it is possible to maintain a well-defined temperature of the gaseous refrigerant in the two chambers. As the temperature and the pressure are well-defined and the volume of the metering chamber is moreover known it is possible to charge said chamber with a well-defined amount of refrigerant. The amount of refrigerant charged to the refrigeration system is determined by the amount of refrigerant introduced into the metering chamber multiplied with the predetermined number of the counter. Accordingly, it is possible to effect a very accurate recharging of the refrigeration system 42 which makes it possible both to avoid the risk of damaging the compressor by overcharging the system and the risk of deteriorating the operation efficiency of the refrigeration system by under-charging. The recharging may be effected automatically and accordingly the operator, who uses the apparatus, need not have special skills. The operator needs only to adjust the counter to the refrigeration system to be serviced. Hereafter, the emptying and the recharging are effected automatically.

The apparatus may be used with known refrigerants, e.g. (early) types of freon R12, R22. In the apparatus, it is also possible to use new types of freon, e.g. R124A, propane and other new types which are less hazardous to the environment as they do not cause any decomposition of the ozone layer.

The monitoring of the liquid level in the storage chamber 30 of the charging container is effected visually by means of the sight glass 29 and electronically by means of the level sensor 33. The storage chamber 30 is replenished via a connection stub 26 preferably of a self-closing type, e.g. a schrader-valve. In order to replenish the storage chamber 30, the operator activates the button K on the control box 41. Hereby a process is started corresponding to the above-described discharging process (by activating the button B). However, during replenishing, the valve 5 is closed and the magnet valve 36 is opened. In this way the compressor 3 establishes a vacuum in the storage chamber 30, thus effecting the replenishing to be carried out easily and without causing any damage to the environment as there is no risk of any gaseous refrigerant escaping to the atmosphere. When a predetermined liquid level has been reached in the storage chamber 30, the level sensor 33 emits a signal stopping the replenishing. As a precaution, the storage chamber 30 is provided with a safety valve 27 effecting a blow-off in case an unacceptable pressure is established in the storage chamber. Such blow-off may be effected through a filter (not shown) which retains the refrigerant.

Having stopped the replenishing and having ended the recharging sequence, the apparatus is stopped by activating the button H, and the valve 5 is closed before the connection between the apparatus and the refrigeration system 42 is disconnected.

When activating the button I it is possible for the operator to choose between automatical or semi-automatical operation and accordingly it is possible to interfere in a sequence, e.g. in order to use the apparatus for emptying a refrigeration system only or in order to use the apparatus for recharging a refrigeration system only.

It is appreciated that various modifications to the inventive concepts may be apparent to those skilled in the art without departing from the spirit and the scope of the invention.

I claim:

1. A method for emptying and recharging a refrigeration system using an apparatus comprising a discharge container, a charging container, pump means, and conduit means comprising closing valves and arranged for connecting the refrigeration system to elements of the apparatus, wherein the discharge container comprises a discharge storage chamber and a suction chamber and said charging container comprises a charge storage chamber for liquid refrigerant and a metering chamber, said pump means consisting of a compressor arranged through conduit means between the chambers of the discharge container by an appropriate setting of the closing valves and which, through the conduit means, is arranged between the chambers of the discharge container by an appropriate setting of the closing valves and arranged between the refrigeration system and the atmosphere through another setting of the closing valves in order to evacuate the refrigeration system, a connection being provided between the storage chamber and the metering chamber for introducing a gaseous refrigerant into the metering chamber, said method comprising the steps of:

emptying refrigerant from the refrigeration system with said pump means by drawing refrigerant into the suction chamber of said discharge container;

transmitting the gaseous refrigerant through the compressor to said discharge storage chamber in which the refrigerant is condensed;

automatically disconnecting the compressor when the refrigerant has been discharged;

changing the position of the closing valves in order to evacuate refrigerant from the refrigeration system with the compressor by creating a vacuum in the refrigeration system when evacuating to the atmosphere;

evaporating clean refrigerant contained in the charge storage chamber;

conducting the gaseous refrigerant into the metering chamber;

using the evaporated and pressurized refrigerant for flushing the refrigeration system and transmitting said refrigerant through the compressor to the discharge container;

evacuating again refrigerant from the refrigeration system;

charging clean refrigerant into the refrigeration system as gaseous refrigerant is introduced into the metering chamber until a predetermined pressure is reached and the pressurized refrigerant flows into the refrigeration system after the position of the closing valves has been changed; and charging and emptying the metering chamber in a corresponding way until a predetermined number of cycles have been effected whereby a well-defined amount of refrigerant has been charged to the system.

2. A method according to claim 1 wherein heat exhange is effected between the chambers of the discharge container, so that an evaporation process and a condensation process support each other.

3. A method according to claim 1, wherein heat exchange is effected between the chambers of the charging container during the recharging and wherein the same temperature is maintained in the refrigerant contained in the two chambers.

4. A method according to claim 1, wherein the liquid level is automatically monitored in the storage chamber of the discharge container and wherein a sensor emits a signal to the monitoring and control units thus stopping the compressor when a maximum allowable level has been reached.

5. A method according to claim 1, wherein the liquid level is automatically monitored in the storage chamber of the charging container and wherein a sensor emits a signal to the monitoring and control unit in order to ensure replenishing of refrigerant in case a predetermined minimum level has been reached.

6. A method according to claim 1, wherein the temperature in the suction chamber of the discharge container is maintained at a preset level in order to settle contaminations in the suction chamber and wherein such contaminations are at intervals removed from the suction chamber.

* * * * *